United States Patent [19]

Osborn

[11] Patent Number: 4,809,534

[45] Date of Patent: Mar. 7, 1989

[54] TORQUE LIMITING PLIERS

[75] Inventor: Merritt A. Osborn, Chesterland, Ohio

[73] Assignee: The Bares Group, Chagrin Falls, Ohio

[21] Appl. No.: 139,803

[22] Filed: Dec. 30, 1987

[51] Int. Cl.[4] ..... B21D 7/06

[52] U.S. Cl. ..... 72/409; 81/362; 29/751

[58] Field of Search ..... 72/409, 410; 81/355, 81/362, 361, 467, 479, 478, 356, 363; 29/751

[56] References Cited

U.S. PATENT DOCUMENTS

| | | | |
|---|---|---|---|
| 2,786,378 | 3/1957 | Ethington et al. | 81/478 |
| 2,875,655 | 3/1959 | Lako | 81/363 |
| 4,144,738 | 3/1979 | Dziura et al. | 72/410 |
| 4,240,280 | 12/1980 | Foslien | 72/410 |
| 4,274,352 | 6/1981 | Hamel | 81/363 |
| 4,477,937 | 10/1984 | Costello | 81/367 |
| 4,478,114 | 10/1984 | Arena | 81/363 |
| 4,640,117 | 2/1987 | Anderson et al. | 72/410 |

FOREIGN PATENT DOCUMENTS

| | | | |
|---|---|---|---|
| 1183842 | 7/1959 | France | 72/410 |
| 587349 | 1/1959 | Italy | 81/478 |
| 694518 | 7/1953 | United Kingdom | 72/409 |

*Primary Examiner*—Daniel C. Crane
*Attorney, Agent, or Firm*—William N. Hogg

[57] ABSTRACT

A hand tool for crimping a work piece by sliding jaw action is provided. The tool has a first handle which fixedly mounts a first jaw at one end thereof and slidably mounts a second jaw in a channel formed therein. A second handle is pivotally connected to the second jaw. A link is pivotally connected to both the first and second handle. A detent device, or piezo electric crystal and read out are provided in the structure to give either a release or a read out response responsive to the generation of a predetermined force load on a work piece.

4 Claims, 2 Drawing Sheets

TORQUE LIMITING PLIERS

BACKGROUND OF THE INVENTION

1. Field of the Invention

This invention relates generally to hand tools, and more particularly to hand tools for applying pressure to a work piece. In even more particular aspects, this invention relates to squeeze action hand tools which will generate a given reaction responsive to a predetermined force being applied to a work piece and is especially adapted for use in crimping type operations.

2. Background Art

Crimping and other force applying tools are well known in the art. These tools are used to apply a limited force to a work piece, such as crimping terminals to wire ends or applying other types of fittings or harnesses to wires, or wire bundles. Typically these tools provided a jaw action that is limited after a predetermined amount of travel, or within a given distance of full closure. However, one tool, described in U.S. Pat. No. 4,640,117, is configured to react after a predetermined amount of force has been applied rather than at a given distance of travel or degree of closure. This tool has a very good force limiting feature, but the jaw action is rather complex, requiring relatively complex and expensive jaw parts. This jaw design also requires a great deal of precision in parts construction to maintain a proper plane of travel of the moving jaw to thereby assure that the jaw remain parallel during the squeezing action. The necessity of the jaws to remain parallel is especially important when the work piece being squeezed is relatively wide and/or long, and the force must be essentially uniform over the entire surface. Further, and of great significance, is that the force multiplication at the jaws of this design is a linear function of the force applied to the handles. Thus, the force that can be applied to the work piece is limited to the amount of force that can be applied to the handles over their path of travel. Expressed another way, the force applied by the jaws is a contrast multiple of the force applied to the handles. Thus the amount of force available is limited by the handle configuration.

SUMMARY OF THE INVENTION

According to the present invention, a force limiting or torque limiting tool is provided having an improved jaw mechanism construction utilized in conjunction with a force sensing and/or force limiting feature. The jaw construction is relatively simple, yet provides an arrangement which assures that the jaw remains on essentially parallel planes through their operating range and thus apply a substantially uniform pressure to all areas of the work piece on which it acts. This jaw and operating arrangement also provides an increasing force multiplication as jaw travel progresses, thus allowing for a large force application at jaw closure. The mechanism includes a first handle member which fixedly mounts a first jaw thereon. A second jaw is slidably mounted on said first handle member for movement toward and away from the first jaw, and biasing means are provided to bias the second jaw away from the first jaw. A second handle member is pivotally connected at one end thereof to the second jaw, and a link is provided which is pivotally connected at one end thereof to the first handle member and pivotally connected at the other end thereof to the second handle member, whereby squeezing of the handles together through the action of the link will cause the second jaw to slide toward the first jaw while maintaining their planar relationship.

Means are also incorporated in the tool which provide a given reaction or indication responsive to a predetermined force generated by the action of the jaws on a work piece. In one embodiment this takes the form of an articulated handle with detent means cooperating with the articulation of the handle to "release" at a given force. In another embodiment the reaction responsive means includes a piezo electric crystal and read out means to translate and read out the electric signal as a force related display.

DESCRIPTION OF THE PREFERRED EMBODIMENTS

Figures 1, 4:
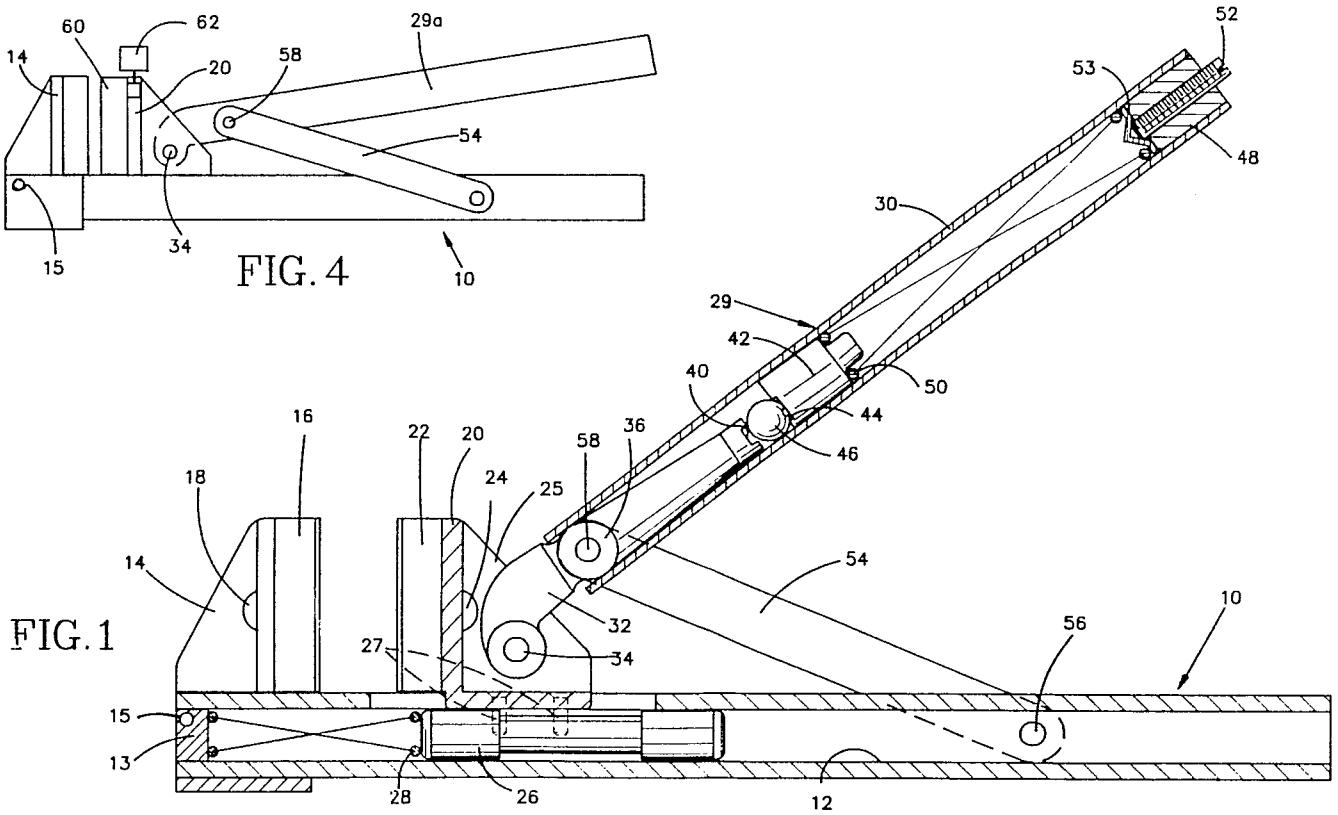
FIG. 1 is a side elevational view, partially in section in the open position of one embodiment of a hand tool according to this invention.
FIG. 4 is a side elevational view partially in section of another embodiment of a hand tool according to this invention.
Figure 3:
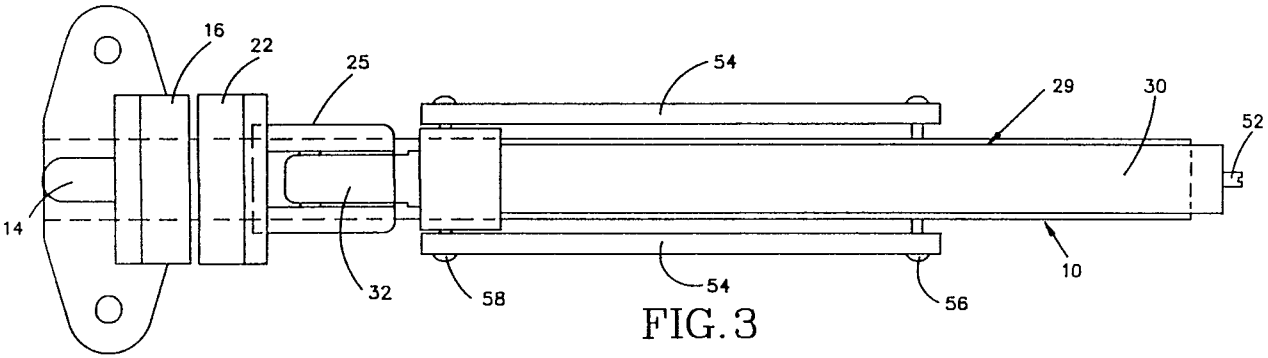
FIG. 3 is a plan view partially in section of the tool shown in FIGS. 1 and 2.
Figure 2:
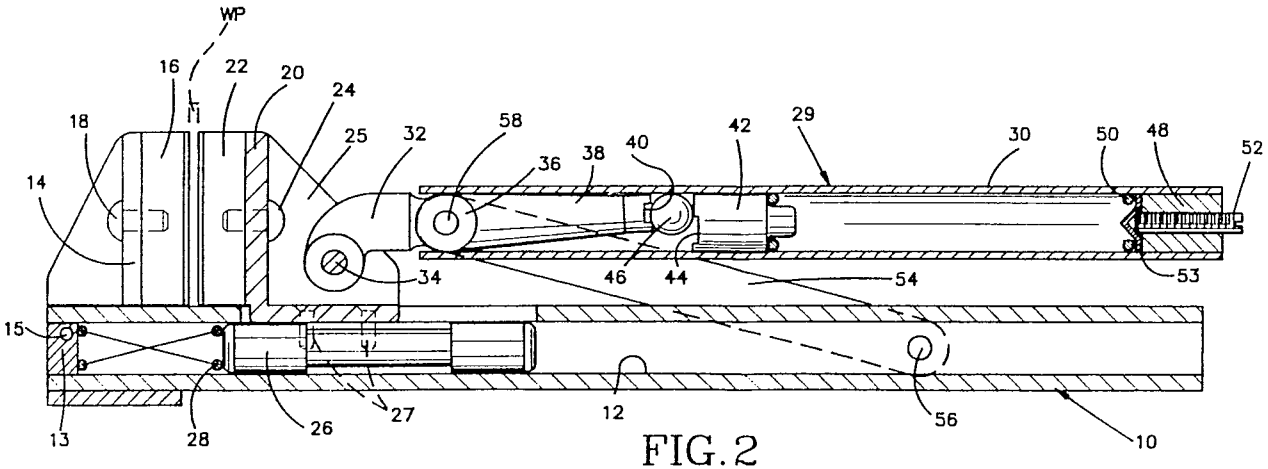
FIG. 2 is a side elevational view, partially in section of the tool of FIG. 1 in its position after a predetermined force has been applied.

Referring to the drawings, and for the present to FIGS. 1 through 3, one embodiment of a hand tool according to this invention is shown.

The tool includes a first handle member 10 which has formed therein a longitudinally extending channel 12 closed at one end thereof by a plug 13. A first, or fixed, jaw member 14 is secured to one end of the handle 10 by means of a pin 15 which passes through the handle 10 and plug 13. A die or face plate 16 is mounted onto the jaw member 14 by means of screws 18. A second, or movable, jaw member 20 is provided, which also has a die or face plate 22 secured thereto by screws 24 and has a flange 25 at the opposite end. The jaw member 20 is mounted on slide rod 26 by screws 27 which slide rod 26 is slidably mounted in channel 12. Movement of the slide rod 26 in the channel 12 will move the jaw 20 toward or away from the jaw 14. A coil spring 28 is disposed in the channel 12 in compression between the plug 13 at the end of the channel and the slide rod 26 and thus normally biases the jaw 20 away from the jaw 14.

A second handle member 29 is provided which has a generally tubular hollow torque arm section 30 and an angled connection section 32. One end of the connection section 32 is pivotally connected to the flange 25 of the jaw 20 by a connection pin 34. The connection section 32 is configured with an intermediate ball or knob section 36 and an extension section 38 terminating in a groove 40.

The torque arm section 30 is telescoped over the extension section 38 and is pivotally carried on the knob section 36. Disposed within the hollow torque arm 30 is a slider 42 which has a groove 44 formed therein which faces the groove 40 on the connection section 32. A ball detent 46 is captivated between the slider 42 and the end of the extension section 38.

An end plug 48 is mounted internally at the end of the torque arm section 30 and a compression coil spring 50 is disposed in the torque arm 30 between the slider 42 and end plug 48. An adjusting screw 52 is threaded through the end plug 48 and acts through plate 53 against the spring 50 to adjust the compression force of the spring 50 for a purpose which will be described later.

A bifurcated connecting link 54 is provided which is pivotally connected at one end to the first handle 10 by means of pivot pin 56, and at the other end pivotally connected to both the torque arm section 30 and connection section 32 of the handle 29 by means of pivot pin 58.

The normal open or non-compressed position of the tool is shown in FIG. 1. The tool is normally maintained in this position by the bias of spring 28. In this position the ball detent 46 is normally captivated within the grooves 40 and 44, and held there firmly by the action of coil spring 50. The faces of the jaws 14 and 20 are preferably disposed on essentially parallel planes.

Squeezing of handles 10 and 29 together will move the tool from its open position shown in FIG. 1 toward its closed position shown in FIG. 2. During this movement, the squeezing action of the handle will move the jaw 20 toward jaw 14, and since this movement is sliding along the handle 10 on a line perpendicular to the face of stationary jaw 14, the face of the movable jaw 20 will remain essentially parallel to the face of the stationary jaw 14. The dies or face plates 16 and 22 can be configured to accept any desired profile of work piece, and can easily be changed to accommodate different desired work piece profiles.

During the initial portion of the movement of the handles 10 and 29, the handle 29 will act as a unitary structure, just as any conventional handle and this will continue until resistance to a work piece is encountered. (A work piece contained between the jaws is shown in broken lines and designated as WP in FIG. 2.) Also during this movement as pivot pin 34 moves to the left, the location of pivot pin 58 moves downwardly and to the left. When resistance of a work piece is encountered, continued squeezing will increase the reaction force exerted by the work piece on the jaws 16–20, and when this force is greater than the force generated by the spring 50, the ball detent 46 will move the slider to the right (as viewed in FIGS. 1 and 2) releasing the ball detent 46 from groove 44 and allowing the torque arm section 30 to pivot on the knob section 36 while the connection section 32 remains fixed or unmoving, thus causing a physically perceptible "break" or "release" in the handle 29. This "break" occurs at a predetermined reaction force load generated by the action of the work piece on the jaws and occurs at the point when this force overcomes or is greater than the force generated by the coil spring 50. As noted above, the adjustment screw 52 can be adjusted to vary the force on the spring 50 and thus adjust the force at which the handle 29 "breaks" or "releases".

The use of this adjustable force feature, in conjunction with a sliding jaw which maintains an essentially parallel relationship with a stationary jaw, and allows for the generation of a very smooth, yet rapidly rising, evenlydistributed force over the work piece. With the jaw and linkage the force multiplication is not linear, but actually increases along the path of travel, so that during the crimping action a significantly increasing force multiplication is achieved, thus avoiding the need for excessive force on the input handles. This particular characteristic is especially useful in certain crimping operations where a predetermined force must be multiplied and uniformly applied to effectuate crimping, but prevent damage to the wires. In particular, the crimping of an electronic harness onto a group of several wires is particularly suited for being performed by the tool of this invention.

Referring now to FIG. 4, a side elevational view, similar to FIG. 1, is shown of another embodiment of a tool according to this invention. In this embodiment, all of the components are the same with the exception of the second handle 29a, which is a solid member. A piezo electric crystal 60 is disposed in the jaw 20 behind the face plate 22. A conventional signal read out or display device 62 is connected to the piezo electric crystal 60, and is calibrated to read and display the electrical signal generated by the crystal 60 under compression in appropriate units. Thus when the handles are squeezed together and force is being generated by the resistance of the workpiece, the force will cause the crystal 60 to generate a signal proportional to the force which is read out by the read out 62.

While several embodiments of the invention have been shown, numerous changes and modifications can be made without departing from the scope of the invention as defined in the appended claims.

What is claimed is:

1. A torque limiting hand tool comprising, a first handle member, a first jaw fixedly carried by said first handle member, a second jaw, means mounting said second jaw on said first handle member for slidable movement toward and away from said first jaw, a second handle member, said second handle member including first and second sections in telescoping relationship wherein said first section is pivotally connected to the second jaw, and said second section is pivotally connected to said first section;

detent means captivated between said first and second sections and disposed to release at a predetermined force;

link means pivotally connected at one end thereof to said first handle member and at the other end thereof pivotally connected to said second handle member at the pivotal connection of the two sections, and means normally biasing said second jaw away from said first jaw;

whereby the handle will provide a given torque level to said link irrespective of the location on the second handle at which actuating force is applied.

2. The invention as defined in claim 1, wherein said pivotal connection of said arm sections includes one section having a knob portion mounting said other section for pivotal movement.

3. The invention as defined in claim 1 wherein said detent means including means to adjust the predetermined force required for release.

4. The invention as defined in claim 3, wherein said means to adjust the predetermined force include spring means operatively associated with said detent means, and means to vary the spring force.

* * * * *